US011396692B2

(12) United States Patent
Chaudhari et al.

(10) Patent No.: US 11,396,692 B2
(45) Date of Patent: Jul. 26, 2022

(54) METHOD OF HEAT TREATING AN ARTICLE

(71) Applicant: FLUID CONTROLS PRIVATE LIMITED, Mumbai (IN)

(72) Inventors: Tansen Dhananjay Chaudhari, Mumbai (IN); Rahul Manikrao Patil, Mumbai (IN)

(73) Assignee: FLUID CONTROLS PRIVATE LIMITED, Mumbai (IN)

( * ) Notice: Subject to any disclaimer, the term of this patent is extended or adjusted under 35 U.S.C. 154(b) by 0 days.

(21) Appl. No.: 17/256,228

(22) PCT Filed: Apr. 10, 2019

(86) PCT No.: PCT/IN2019/050294
§ 371 (c)(1),
(2) Date: Dec. 27, 2020

(87) PCT Pub. No.: WO2020/170264
PCT Pub. Date: Aug. 27, 2020

(65) Prior Publication Data

US 2021/0222278 A1 Jul. 22, 2021

(30) Foreign Application Priority Data

Feb. 21, 2019 (IN) ..... 201921006832

(51) Int. Cl.

| | |
|---|---|
| ***C23C 8/22*** | (2006.01) |
| ***C21D 1/06*** | (2006.01) |
| ***C21D 9/08*** | (2006.01) |
| ***C21D 6/00*** | (2006.01) |

(52) U.S. Cl.
CPC ..... *C23C 8/22* (2013.01); *C21D 1/06* (2013.01); *C21D 6/004* (2013.01); *C21D 9/08* (2013.01)

(58) Field of Classification Search
CPC ... C22F 1/047; C22F 1/06; C23C 8/22; C21D 1/06; C21D 6/004; C21D 9/08
See application file for complete search history.

(56) References Cited

U.S. PATENT DOCUMENTS

| | | | | |
|---|---|---|---|---|
| 4,242,151 | A * | 12/1980 | Leveque | C21D 1/18 148/217 |
| 6,238,490 | B1 | 5/2001 | Bell et al. | |
| 2012/0018052 | A1 | 1/2012 | Moyer | |
| 2015/0159260 | A1 | 6/2015 | Bremer et al. | |

FOREIGN PATENT DOCUMENTS

| | | | |
|---|---|---|---|
| CN | 105603359 | A | 5/2016 |
| EP | 2881492 | A1 | 6/2015 |
| JP | 2007016273 | A | 1/2007 |
| JP | 2016188417 | A | 4/2018 |
| WO | 2002022908 | A2 | 3/2002 |
| WO | 2010016378 | A1 | 2/2010 |

OTHER PUBLICATIONS

International Search Report for patent application PCT/IN2019/050294 issued by the Indian Patent Office dated Oct. 4, 2019.
Article "Low-Temperature Carburization of Austenitic Stainless Steels", ASM Handbook, vol. 4D: Heat Treating of Irons and Steels, ISBN:978-1-62708-066-08, Oct. 2015.
Written Opinion of the International Searching Authority for patent application PCT/IN2019/050294 issued by the Indian Patent Office dated Oct. 4, 2019.
BSI Standards Publication: Railway applications—Rolling stock equipment—Shock and vibration tests, Be En 61373(2010) standard, The British Standards Institute, 2012.
Metallic tube connections for fluid power and general use—Test methods for hydraulic fluid power connections, ISO, Second edition, Sep. 15, 2010.
Examination Report by the Patent Office of India in related Indian patent application 201921006832 having date of dispatch/email of Oct. 29, 2021, in English, any non-English text immediately translated below non-English text in English, 7 pages.

* cited by examiner

*Primary Examiner* — Jessee R Roe
(74) *Attorney, Agent, or Firm* — Hassan Abbas Shakir; Shakir Law PLLC

(57) ABSTRACT

The invention describes a method of heat-treating an article, which includes a first step of heating the article to a temperature of 400° C. to 500° C. at a pressure of 1 to 3 millibar in an atmosphere comprising hydrogen for a period of 0.1 to 50 hours to produce a hot article, a second step of heating the hot article at a temperature of 400° C. to 500° C. at a pressure of 1 to 3 millibar in an atmosphere comprising at least one of hydrogen, argon, and nitrogen, for 0.1 to 50 hours to produce a preliminary heat treated article, and a third step of heating the preliminary heat treated article at a temperature of 400° C. to 500° C. at a pressure of 1 to 3 millibar in an atmosphere comprising at least one of hydrogen, nitrogen, and a hydrocarbon gas, for 0.1 to 50 hours; to produce a heat-treated article.

19 Claims, 1 Drawing Sheet

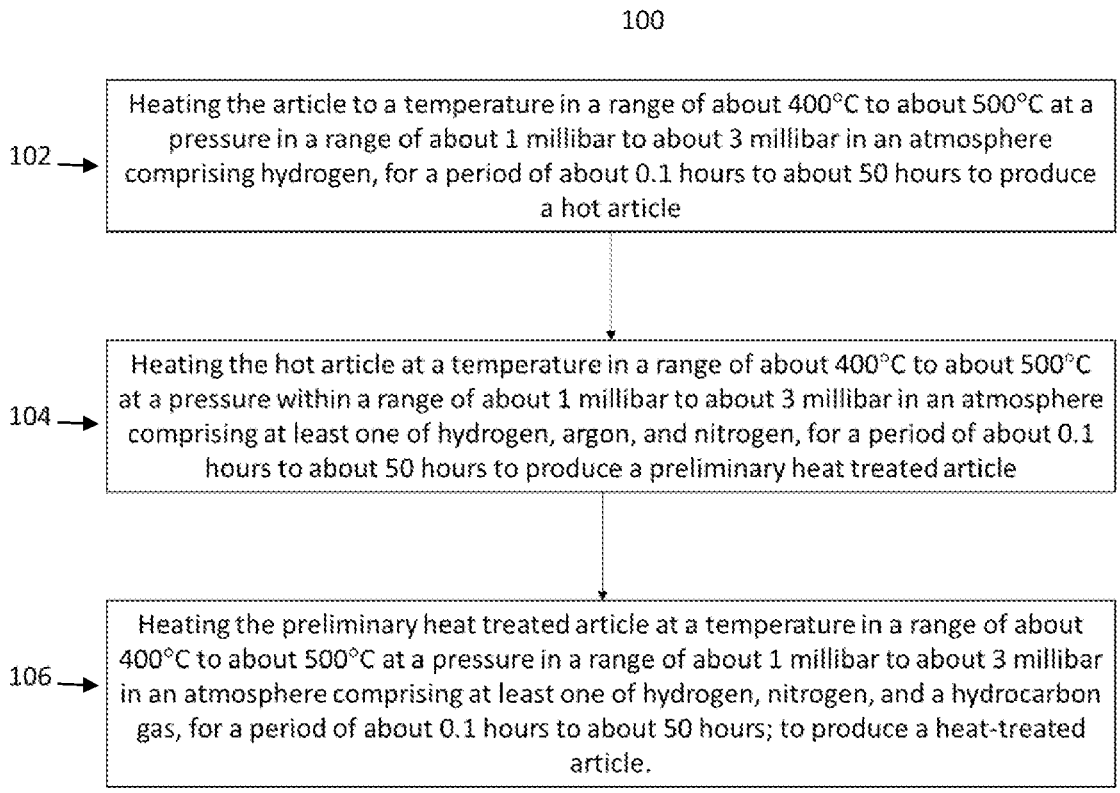
100
102
Heating the article to a temperature in a range of about 400°C to about 500°C at a pressure in a range of about 1 millibar to about 3 millibar in an atmosphere comprising hydrogen, for a period of about 0.1 hours to about 50 hours to produce a hot article
104
Heating the hot article at a temperature in a range of about 400°C to about 500°C at a pressure within a range of about 1 millibar to about 3 millibar in an atmosphere comprising at least one of hydrogen, argon, and nitrogen, for a period of about 0.1 hours to about 50 hours to produce a preliminary heat treated article
106
Heating the preliminary heat treated article at a temperature in a range of about 400°C to about 500°C at a pressure in a range of about 1 millibar to about 3 millibar in an atmosphere comprising at least one of hydrogen, nitrogen, and a hydrocarbon gas, for a period of about 0.1 hours to about 50 hours; to produce a heat-treated article.

METHOD OF HEAT TREATING AN ARTICLE

BACKGROUND OF THE INVENTION

1. Field of the Invention

The present invention relates to a method of heat treating an article. More specifically, the invention relates to a method of heat treating stainless steel articles such as bite type of fittings.

2. Discussion of the Related Art

Various methods of heat treating stainless steel articles are known in the art. U.S. Pat. No. 6,238,490 refers to a process for heat-treating austenitic steel articles to produce a hardened surface by heating the article in a gas mixture of hydrogen and methane. US patent application number 20120018052 describes a process for carburization of an article made of steel, in a vacuum furnace in the presence of a hydrocarbon carburizing gas. While, Chinese patent application number 105603359 seems to describe a method for glow ion carbonization of stainless steel for enhanced surface hardness and corrosion resistance. However, these methods often need special heat treatment furnaces.

Therefore, there is a need in the art for a process for heat treating a stainless steel article at low temperatures to impart a balance of good surface hardness and good corrosion resistance which can be processed in commonly available furnaces.

SUMMARY OF THE INVENTION

One embodiment of the present invention is a method of heat treating an article. The method includes a first step of heating the article to a temperature in a range of about 400° C. to about 500° C. at a pressure in a range of about 1 millibar to about 3 millibar in an atmosphere comprising hydrogen, for a period of about 0.1 hours to about 50 hours to produce a hot article. The method includes a second step of heating the hot article at a temperature in a range of about 400° C. to about 500° C. at a pressure within a range of about 1 millibar to about 3 millibar in an atmosphere comprising at least one of hydrogen, argon, and nitrogen, for a period of about 0.1 hours to about 50 hours to produce a preliminary heat treated article. Further, the method includes a third step of heating the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a period of about 0.1 hours to about 50 hours; to produce a heat-treated article.

BRIEF DESCRIPTION OF THE DRAWINGS

FIG. 1 is a method of heat treating an article in accordance to an embodiment of the invention.

DETAILED DESCRIPTION OF THE INVENTION

In the specification and the claims which follow, reference will be made to a number of terms which shall be defined to have the following meanings:

The singular forms "a", "an" and "the" include plural referents unless the context clearly dictates otherwise.

"Optional" or "optionally" means that the subsequently described event or circumstance may or may not occur, and that the description includes instances where the event occurs and instances where it does not. "Substantially" means a range of values that is known in the art to refer to a range of values that are close to, but not necessarily equal to a certain value.

Other than in the examples or where otherwise indicated, all numbers or expressions referring to quantities of ingredients, reaction conditions, and the like, used in the specification and claims are to be understood as modified in all instances by the term "about."

As used herein, the term "substantially" and its variations are defined as being largely but not necessarily wholly what is specified as understood by one of ordinary skill in the art.

Various numerical ranges are disclosed herein. Because these ranges are continuous, they include every value between the minimum and maximum values. The endpoints of all ranges reciting the same characteristic or component are independently combinable and inclusive of the recited endpoint. Unless expressly indicated otherwise, the various numerical ranges specified in this application are approximations. The endpoints of all ranges directed to the same component or property are inclusive of the endpoint and independently combinable.

As used herein, "combinations thereof" is inclusive of one or more of the recited elements, optionally together with a like element not recited, e.g., inclusive of a combination of one or more of the named components, optionally with one or more other components not specifically named that have essentially the same function. As used herein, the term "combination" is inclusive of blends, mixtures, alloys, reaction products, and the like.

As used herein, the term "bite type fitting" refers to an article that is used for joining two tubes. The bite type fitting is composed of an outer compression nut and an inner compression ferrule. When the nut is tightened, the ferrule is compressed between the nut and the body of the fitting, thus forming a tight, leak-proof joint.

As used herein the term "standard cubic centimetres per minute" or "sccm" is defined as a gas flow rate corresponding to a cubic centimeter of gas flowing in one minute.

One embodiment of the present invention is a method of heat treating an article, the method includes a first step of heating the article to a temperature in a range of about 400° C. to about 500° C. at a pressure in a range of about 1 millibar to about 3 millibar in an atmosphere comprising hydrogen, for a period of about 0.1 hours to about 50 hours to produce a hot article, a second step of heating the hot article at a temperature in a range of about 400° C. to about 500° C. at a pressure within a range of about 1 millibar to about 3 millibar in an atmosphere comprising at least one of hydrogen, argon, and nitrogen, for a period of about 0.1 hours to about 50 hours to produce a preliminary heat treated article. The method further includes a third step of heating the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a period of about 0.1 hours to about 50 hours; to produce a heat-treated article.

As depicted in FIG. 1 according to an embodiment of the present invention, the method 100 consists of the following steps: heating 102 the article to a temperature in a range of about 400° C. to about 500° C. at a pressure in a range of about 1 millibar to about 3 millibar in an atmosphere comprising hydrogen, for a time of about 0.1 hours to about 50 hours to produce a hot article; heating 104 the hot article at a temperature in a range of about 400° C. to about 500° C. at a pressure within a range of about 1 millibar to about 3 millibar in an atmosphere comprising at least one of hydrogen, argon, and nitrogen, for a time of about 0.1 hours to about 50 hours to produce a preliminary heat treated article, and heating 106 the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a time of about 0.1 hours to about 50 hours to produce a heat-treated article.

In an embodiment of the present invention, the article is subjected to a cleaning step before being heat treated. The cleaning step may include but not limited to a water washing step, an acetone washing step, a degreasing step, a chemical cleaning step, a solvent cleaning step, an ultrasonic cleaning step, a plasma cleaning step, an electrochemical cleaning step, or any other such cleaning step commonly known to one skilled in the art. In an embodiment of the present invention, the article is subjected to an acetone washing step.

In an embodiment of the present invention, the temperature in the first step and the second step may be within a range of about 380° C. to about 440° C. In another embodiment of the present invention, the temperature in the first step and the second step is 425° C. In an embodiment of the present invention, the temperature in the third step may be within a range of about 380° C. to about 440° C.

In an embodiment of the present invention, the pressure in the first step may be within a range of about 1 millibar to about 3 millibar. In an embodiment of the present invention, the pressure in the first step may be about 2 millibar. In an embodiment of the present invention, the pressure in the second step may be within a range of about 3 millibar to about 5 millibar. In an embodiment of the present invention, the pressure in the second step may be 4 millibar. In an embodiment of the present invention, the pressure in the third step may be within a range of about 1 millibar to about 3 millibar. In an embodiment of the present invention, the pressure in the third step may be about 2 millibar.

The method further includes a third step of heating the preliminary heat treated article in an atmosphere comprising at least one of hydrogen, nitrogen, and a hydrocarbon gas, for a period of about 0.1 hours to about 50 hours; to produce a heat-treated article. In an embodiment of the present invention, the hydrocarbon may be methane, ethane, propane, butane, or a combination thereof. In an example embodiment of the present invention, the hydrocarbon gas may be methane.

In an embodiment of the present invention, the first step may be carried out in a gas flow of about 200 sccm to about 600 sccm of hydrogen. In another embodiment of the present invention, the first step may be carried out in a gas flow of about 450 sccm of hydrogen. In an embodiment of the present invention, the second step may be carried out in a gas flow of about 400 sccm to about 1000 sccm of hydrogen, about 200 sccm to about 800 sccm of nitrogen and about 10 sccm to about 50 sccm of argon. In another embodiment of the present invention, the second step may be carried out in a gas flow of about 750 sccm of hydrogen, about 500 sccm of nitrogen and about 10 sccm to about 50 sccm of argon. In yet another embodiment of the present invention, the third step may be carried out in a gas flow of about 400 sccm to about 1000 sccm of hydrogen, about 200 sccm to about 800 sccm of nitrogen, and about 20 to about 100 sccm of a hydrocarbon. In an example embodiment of the present invention, the third step may be carried out in a gas flow of about 850 sccm of hydrogen, about 600 sccm of nitrogen, and about 50 sccm of a hydrocarbon.

In an embodiment of the present invention, the first step may be carried out in a period of about 0.1 hours to about 50 hours. In another embodiment of the present invention, the first step may be carried out in a period of about 6 hours. In an embodiment of the present invention, the second step may be carried out for a period of about 0.1 hours to about 50 hours. In yet another embodiment of the present invention, the second step may be carried out for a period of about 12 hours. In an embodiment of the present invention, the third step may be carried out for a period of about 0.1 hours to about 50 hours. In another one embodiment of the present invention, the third step may be carried out for a period of about 16 hours.

In an embodiment of the present invention, the method of heat treating the article further includes a step of tempering the heat treated article. In an embodiment of the present invention, the method of heat treating the article further includes a step of tempering the heat treated article at a temperature of about 600° C., for a time of about 4.5 hours. In another embodiment of the present invention, the method of heat treating the article further includes a step of tempering the heat treated article at a temperature within a range of about 400° C. to about 800° C., for a time of about 0.1 hours to about 50 hours. In yet another embodiment of the present invention, the method of heat treating the article further includes a step of tempering the heat treated article at a temperature within a range of about 550° C. to about 620° C., for a time of about 3.5 hours to about 6 hours.

In an embodiment of the present invention, the heat treated article after the tempering step has been carried out, has a Vickers hardness from about 800 units to about 880 units. In an embodiment of the present invention, the heat treated article has a Vickers hardness from about 650 units to about 800 units.

In an embodiment of the present invention, the article may be an austenitic stainless steel article. In an embodiment of the present invention, the article may be composed of "SS 316" grade stainless steel or "SS304" grade stainless steel or "SS316Ti grade stainless steel.

In an embodiment of the present invention, the article may be a single ferrule fitting. In another embodiment of the present invention, the article may be a gear, a sprocket, a screw, a ball bearing, a roller bearing, a piston pin, a firearm, a chain, a lock shackle, a watch case, a cam shaft, a crankshaft, and the like.

EXAMPLES

Example 1: Commercially available ferrules, such as those manufactured by Fluid Controls Pvt. Ltd., Pune, India, were obtained for heat treatment. The ferrule to be heat treated was placed in a furnace and heated to 425° C. at a pressure of about 2 millibar in an atmosphere comprising a flow of about 400 sccm of hydrogen. The ferrule was held at 425° C. for 2 hours in an atmosphere of 450 sccm of hydrogen, 30 sccm of argon and 600 sccm of nitrogen, at a pressure of 3-5 mbar, for six hours, followed by a step of heating the ferrule at 425° C. in an atmosphere of 700 sccm of nitrogen, 30 sccm of argon and 50 sccm of methane, for 4-6 hours. The ferrule was subsequently allowed to cool to room temperature.

Example 2: A process similar to the process of example 1 was followed to heat treat a ferrule. In the current example 2, the heat treated ferrule was subjected to a tempering step. A ferrule to be teat treated was placed in a furnace and heated to 425° C. at a pressure of about 2 millibar in an atmosphere comprising a flow of about 400 sccm of hydrogen. The ferrule was held at 425° C. for 2 hours in an atmosphere of 700 sccm of hydrogen, 30 sccm of argon and 650 sccm of nitrogen, at a pressure of 3-5 mbar, for 6 hours, followed by a step of heating the ferrule at 425° C. in an atmosphere of 700 sccm of nitrogen, 40 sccm of argon and 60 sccm of methane, for 8-10 hours. The ferrule was subsequently allowed to cool to room temperature. After the ferrule cooled to room temperature, the ferrule was tempered at a temperature of 600° C. in vacuum for about 5 hours.

Heat treated ferrules of various diameters ranging from 6 mm to about 42 mm outer diameter were tested for leaks according to ISO 19879 standard. Typically, the ferrule was fitted on to a stainless steel tube and tested at 6.3 MPa for a duration of at least three minutes. No leaks were detected in the heat treated ferrules. The heated treated ferrules were tested for leakages due to shock and vibration according to BE EN 61373(2010) standard. The heat treated ferrules were found to meet the specifications laid down in BE EN 61373(2010) standard. The heat treated ferrules fitted on to stainless steel tubes were also tested for leaks due to misalignment. The ferrules were fitted on to steel tubes and clamped. The tubes were then misaligned from the clamped position up to 45 mm, and the ferrule was crimped. The heat treated ferrules were observed to pass the leak tests as per ISO 19879 standard, in spite of the misalignment.

Comparative Examples: Non-heat-treated ferrules, such as those manufactured by Fluid Controls Pvt. Ltd., Pune, India, were obtained for comparison. The non-heat treated ferrules were subjected to the same tests as for the heat-treated ferrules, and the results were compared.

Non-heat treated ferrules were tested for leaks according to ISO 19879 standard. The non-heat treated ferrules employed above were various diameters ranging from 6 mm to about 42 mm outer diameter as mentioned above in the case of the heat treated ferrules. Typically, the ferrule was fitted on to a stainless steel tube and tested at 6.3 MPa for a duration of at least three minutes. No leaks were detected in the non-heat treated ferrules. The non-heat treated ferrules fitted on to stainless steel tubes were also tested for leaks due to misalignment. The non-heat treated ferrules were fitted on to steel tubes and clamped. The tubes were then misaligned from the clamped position up to 45 mm, and the ferrule was crimped. The non-heat treated ferrules were observed to fail the leak tests as per ISO 19879 standard. The leak tests on misaligned fittings have not been seen to be reported previously in literature.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

What is claimed is:

1. A method of heat-treating an article, the method comprising:

a first step of heating the article to a temperature in a range of about 400° C. to about 500° C. at a pressure in a range of about 1 millibar to about 3 millibar in an atmosphere comprising hydrogen, for a period of about 0.1 hours to about 50 hours to produce a hot article;

a second step of heating the hot article at a temperature in a range of about 400° C. to about 500° C. at a pressure within a range of about 1 millibar to about 3 millibar in an atmosphere comprising at least one of hydrogen, argon, and nitrogen, for a period of about 0.1 hours to about 50 hours to produce a preliminary heat treated article;

a third step of heating the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a period of about 0.1 hours to about 50 hours to produce a heat-treated article; and wherein the article is a bite type fitting.

2. The method of claim 1, wherein the temperature in the first step and the second step is 425° C.

3. The method of claim 1, wherein the temperature in the third step is 425° C.

4. The method of claim 1, wherein the hydrocarbon gas is methane.

5. The method of claim 1, wherein the first step is carried out in a gas flow of about 200 sccm to about 600 sccm of hydrogen.

6. The method of claim 1, wherein the second step is carried out in a gas flow of about 400 sccm to about 1000 sccm of hydrogen;

about 200 sccm to about 800 sccm of nitrogen; and about 10 sccm to about 50 sccm of argon.

7. The method of claim 1, wherein the third step is carried out in a gas flow of about 400 sccm to about 1000 sccm of hydrogen;

about 200 sccm to about 800 sccm of nitrogen; and about 20 sccm to about 100 sccm of a hydrocarbon.

8. The method of claim 1, further comprising a step of tempering the article at a temperature within a range of about 400° C. to about 800° C., for a time of about 0.1 hours to about 50 hours.

9. The method of claim 1, wherein the bite type fitting comprises an austenitic stainless steel.

10. A method of heat-treating an article, the method comprising:

a three-step heating process consisting of a first step of heating the article to a temperature in a range of about 400° C. to about 500° C. at a pressure in a range of about 1 millibar to about 3 millibar in an atmosphere comprising hydrogen, for a period of about 0.1 hours to about 50 hours to produce a hot article;

a second step of heating the hot article at a temperature in a range of about 400° C. to about 500° C. at a pressure within a range of about 1 millibar to about 3 millibar in an atmosphere comprising at least one of hydrogen, argon, and nitrogen, for a period of about 0.1 hours to about 50 hours to produce a preliminary heat treated article;

a third step of heating the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a period of about 0.1 hours to about 50 hours to produce a heat-treated article; and wherein the article is an austenitic stainless steel article.

11. The method of claim 10, wherein the first step is carried out in a gas flow of about 200 sccm to about 600 sccm of hydrogen.

12. The method of claim 10, wherein the temperature in the first step and the second step is 425° C.

13. The method of claim 10, wherein the temperature in the third step is 425° C.

14. The method of claim 10, wherein the hydrocarbon gas is methane.

15. The method of claim 10, wherein the second step is carried out in a gas flow of about 400 sccm to about 1000 sccm of hydrogen;

about 200 sccm to about 800 sccm of nitrogen; and about 10 sccm to about 50 sccm of argon.

16. The method of claim 10, wherein the third step is carried out in a gas flow of about 400 sccm to about 1000 sccm of hydrogen;

about 200 sccm to about 800 sccm of nitrogen; and about 20 sccm to about 100 sccm of a hydrocarbon.

17. A method of heat-treating an austenitic stainless steel article, the method comprising:

a first step of heating the article to a temperature in a range of about 400° C. to about 500° C. at a pressure in a range of about 1 millibar to about 3 millibar in an atmosphere comprising hydrogen, for a period of about 0.1 hours to about 50 hours to produce a hot article;

a second step of heating the hot article at a temperature in a range of about 400° C. to about 500° C.' at a pressure within a range of about 1 millibar to about 3 millibar in an atmosphere comprising at least one of hydrogen, argon, and nitrogen, for a period of about 0.1 hours to about 50 hours to produce a preliminary heat treated article; and a third step of heating the preliminary heat treated article at a temperature in a range of about 400° C. to about 500° C. at a pressure in a range of about 1 millibar to about 3 millibar in an atmosphere comprising at least one of hydrogen, nitrogen, and a hydrocarbon gas, for a period of about 0.1 hours to about 50 hours to produce a heat-treated article; and wherein the article is a bite type fitting.

18. The method of claim 17, wherein the first step is carried out in a gas flow of about 200 sccm to about 600 sccm of hydrogen.

19. The method of claim 17, further comprising a step of tempering the article at a temperature within a range of about 400° C. to about 800° C., for a time of about 0.1 hours to about 50 hours.

* * * * *